United States Patent [19]

Friedman

[11] Patent Number: 4,780,975

[45] Date of Patent: Nov. 1, 1988

[54] SELF MAILER WITH EASEL

[76] Inventor: Arthur S. Friedman, 2144 Seneca Dr. West, Merrick, N.Y. 11566

[21] Appl. No.: 19,927

[22] Filed: Feb. 26, 1987

[51] Int. Cl.[4] ..... A47G 1/06; G09F 1/12

[52] U.S. Cl. ..... 40/155; 40/152.1; 40/158.1; 229/92.8

[58] Field of Search ..... 40/152.1, 152, 124.1, 40/157 R, 155, 124.4, 156; 229/92.8

[56] References Cited

U.S. PATENT DOCUMENTS

| | | | |
|---|---|---|---|
| 1,347,269 | 7/1920 | Greble | 40/152.1 |
| 1,404,579 | 1/1922 | Chilcote et al. | 40/152.1 |
| 1,421,097 | 6/1922 | Pente | 40/152.1 |
| 2,845,733 | 8/1958 | Fox | 40/152.1 |
| 2,909,313 | 10/1959 | Maish | 229/92.8 |
| 2,991,578 | 7/1961 | Messina | 40/152.1 |
| 3,174,244 | 3/1965 | Walton | 40/158 R |
| 3,266,714 | 8/1966 | Heuberger | 229/92.8 |
| 3,875,693 | 4/1975 | Pelkey | 40/124.1 |
| 4,275,517 | 6/1981 | Blanchard | 40/158 R |
| 4,332,095 | 6/1982 | Tanney | 40/152.1 |
| 4,559,727 | 12/1985 | Lewyt | 40/158 R |

FOREIGN PATENT DOCUMENTS

| | | | |
|---|---|---|---|
| 562145 | 8/1923 | France | 40/158 R |
| 936307 | 6/1948 | France | 229/92.8 |

*Primary Examiner*—Robert Peshock
*Assistant Examiner*—Michael Lynch
*Attorney, Agent, or Firm*—Dennison, Meserole, Pollack & Scheiner

[57] ABSTRACT

A combined mailer and easel-type display frame is formed from a planar blank and comprises first and second overlying panels defining a picture-receiving and displaying pocket. A third panel integral with the lower panel along a fold line coextensive with the open mouth of the pocket is selectively folded between a first position overlying the pocket and closing the mouth thereof and a second rearwardly diverging position defining a support easel. A brace panel is integral with the third panel and includes an outer tongue portion selectively engaged through a slot in the lower panel to secure the third panel in both positions thereof. The brace panel, inward of the tongue, includes a finger-accommodating gripping opening for facilitating manipulation of the tongue. The brace panel is defined by multiple parallel sections with fold lines therebetween for a controlled manipulation of the brace panel for engagement and disengagement of the tongue. A picture retaining panel, with a display border or picture securing flaps may also be integrally joined to the third panel along a fold line to define a second picture displaying pocket or a carrier for multiple pictures.

26 Claims, 4 Drawing Sheets

FIG. 1
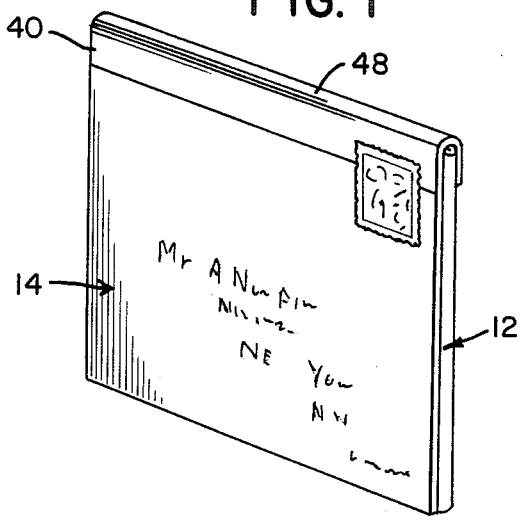
FIG. 2
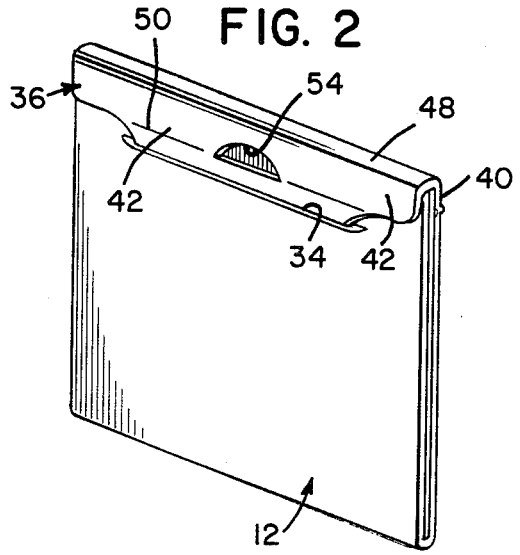
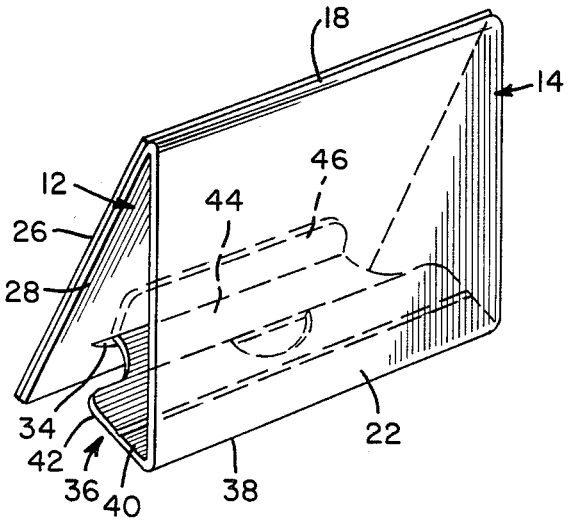
FIG. 3
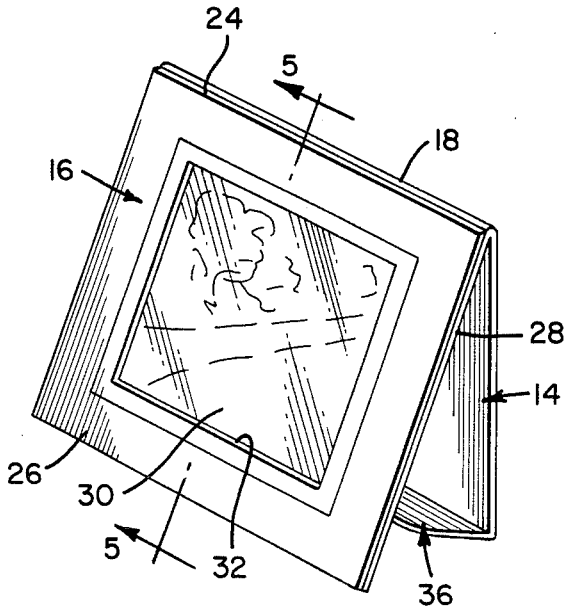
FIG. 4

SELF MAILER WITH EASEL

BACKGROUND OF THE INVENTION

The invention broadly relates to small, inexpensive mounts or display mailers for photographs which are selectively usable as self-contained mailers and as photograph-displaying, easel-supporting, picture frames. Combined self-mailers and picture display frames for single pictures are known in the prior art as exemplified by the following patents:

| Patent No. | Name | Issue Date |
|---|---|---|
| 1,632,185 | Jenner | June 14, 1927 |
| 2,219,492 | Prichap | October 29, 1940 |
| 2,453,902 | Graham | November 16, 1948 |
| 4,450,638 | Bader | May 29, 1984 |

The known constructions are generally assemblies which, in providing for a mounting of the photograph or picture, do so with complex panel arrangements, utilizing separate components to achieve the mounting and securing of the photograph, or single blanks with rather elaborately defined glue lines and assembly procedures.

Prior art collapsible cardboard mounts or display mailers, other than of the more complex structures, have generally been of flimsy construction and not particularly suitable for other than minimal handling. Further, the known assemblies, for the most part, do little to protect the photograph against sliding from the display frame portion in either the mailing configuration or the easel configuration. Also, the known display mailers accommodate only a single photograph or picture both as a mailer and as a display frame.

SUMMARY OF THE INVENTION

The convertible display mailer or mount of the present invention, in the basic embodiment thereof, is formed from a one-piece cardboard blank die-cut to define three fold-connected picture framing and supporting panels which, in conjunction with an integral multiple section tongue and brace panel, provide a compact inexpensive product for positive picture retention in both a mailing configuration and in a display configuration. Other embodiments, also utilizing a one-piece blank construction, provide for the accommodation of multiple pictures for both mailing and display.

Of particular significance with regard to the convertible mount is the formation thereof with minimal components whereby the mount, as a mailer or as a partially folded blank, presents a very thin flat configuration particularly adapted for packaging with film or other products as a premium or give-away.

The display mailer of the invention, in its basic form, readily accommodates a photograph and is easily formed into its mailer configuration and converted from the mailer configuration to the display configuration, the photograph, in either configuration, being effectively secured in display position.

Basically, the mount of the present invention is defined from a single-piece, die-cut blank of smooth surface cardboard or boxboard. The mount includes a backing panel with a rear support panel integrally joined along one edge thereof by a fold line or crease. A frame or border panel is similarly integrally joined to the backing panel along a second edge thereof by a second crease or fold line, the border panel extending at right angles to the rear support panel. The blank is completed by an easel brace panel joined along a fold line or crease along the edge of the support panel remote from the backing panel. In order to provide for the mounting of a photograph, the border panel is folded into overlying relation to the backing panel and joined at its free edge thereto by a single glue line to define a photograph-receiving pocket with open upper and lower edges.

To form the mailer, the rear support panel folds over the border panel, enclosing the open upper edge of the photograph pocket. Subsequently, the brace panel folds about the open lower edge of the pocket with the outermost sections of the brace panel introduced inwardly through the rear of the back panel through a transverse tongue-receiving slot defined therein. The mailer, as thus formed, is compact and provides a smooth front face for reception of postal information, stamps, and the like.

In converting the mailer to an easal-supported display frame, the tongue-defining outer sections of the brace panel are withdrawn from the slot. This withdrawal of the tongue is greatly facilitated, particularly in light of the extremely thin nature of the cardboard, by the provision of a finger-accommodating gripping opening defined through the brace panel immediately inward of the tongue-defining sections and exposed on the back of the formed mailer. The finger-accommodating opening is considered particularly significant in that it enables a withdrawal of the tongue without damage thereto, and without any unnecessary distortion, thereby maintaining the integrity of the tongue and the remainder of the brace panel for use in the display configuration. After withdrawal of the tongue, the rear support panel is swung to an open position behind the back panel and at an angle thereto with the brace panel extending to the back of the back panel and with the tongue reengaged through the tongue slot. The brace panel, in addition to the tongue sections, includes multiple brace sections which allow for manipulation of the tongue with the remainder of the brace panel folding along controlled fold lines, thus avoiding any tendency for the cardboard to crack or break.

As an alternate embodiment, the display mailer or mount can include a second border panel integrally joined along an edge of the rear support panel common with the edge of the backing panel to which the first border panel is joined. The second border panel will fold over and, at the free edge thereof, be adhesively joined to the rear support panel. Thus, two photograph pockets are formed for the accommodation of two photographs both in the mailer and in the display frame.

In a further embodiment, the second photograph pocket is replaced by a photograph carrier defined by a pair of opposed retaining flaps die-cut from an integral panel folded to overly the rear support panel. The flaps flex about crease lines to receive and retain a stack of photographs therebetween and therebeneath particularly in the mailer configuration.

BRIEF DESCRIPTION OF THE DRAWINGS

FIG. 1 is a perspective view of the mount in its mailer configuration;

FIG. 2 is a perspective view of the mailer of FIG. 1 illustrating the reverse side thereof;

FIG. 3 is a perspective view of the rear of the mount erected in its display configuration;

FIG. 4 is a perspective view of the front of the photograph displaying mount;

DESCRIPTION OF PREFERRED EMBODIMENTS

Figure 6:
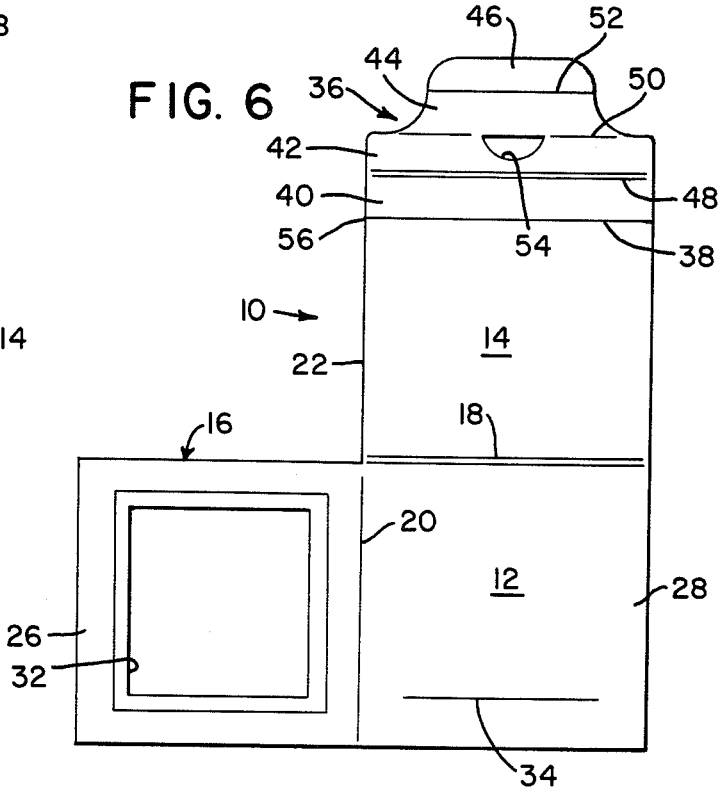
FIG. 6 is a plan view of the blank from which the mounted is formed.

Referring now more specifically to the drawings, and with particular reference to FIG. 6, the photograph mount or display mailer of the invention is constructed from a single die-cut blank 10, preferably formed of smooth surface cardboard or boxboard. The blank 10 is right-angular in shape, and includes three primary rectangular panels, a central backing panel 12, a support panel 14 and a frame or border-defining panel 16.

The panels 14 and 16, in a common plane with the backing panel 12, extend at right angles to each other from a pair of adjacent edges of the panel 12. For purposes of description, and with reference to the blank 10 as illustrated in FIG. 6, the support panel 14 projects vertically above the panel 12 with the integral adjacent edges defined by a full width horizontal fold or crease line 18. The frame panel 16 projects laterally to the left of backing panel 12, and is hingedly integral therewith along a full height vertical fold line 20 which comprises a linear extension of the corresponding or left edge 22 of the support panel 14.

Figure 7:
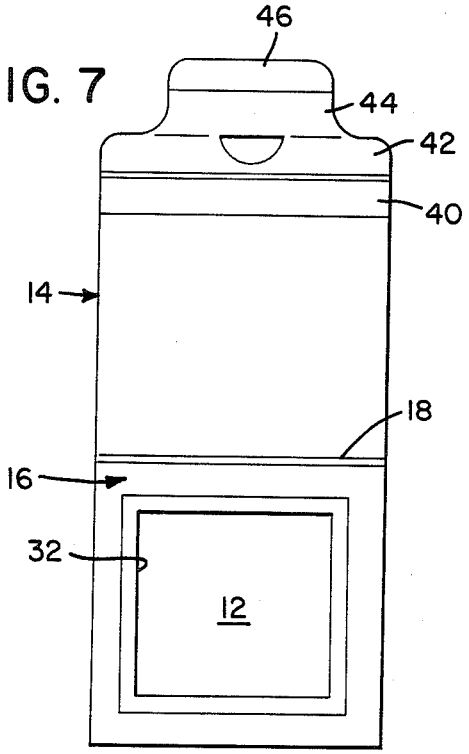
FIG. 7 is a view of the mount with the picture pocket defined thereon prior to folding into either the mailer or display configurations.
Figure 8:
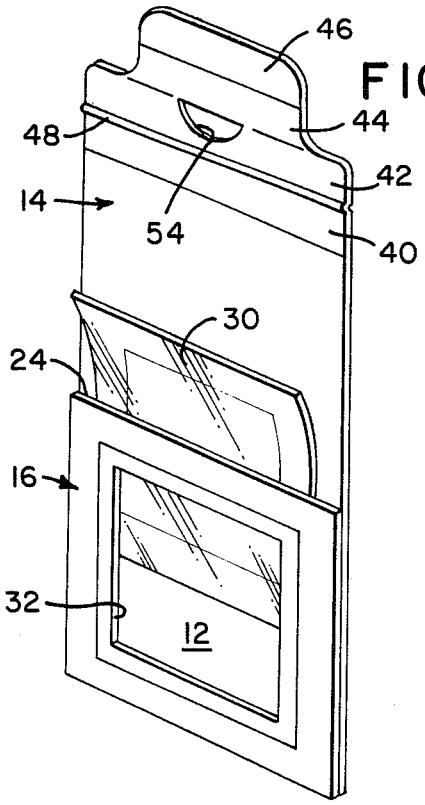
FIG. 8 is a perspective view similar to FIG. 7 illustrating the manner of inserting a photograph.

The frame or border-defining panel 16 is of equal size with the backing panel 12 and, as will be apparent from FIGS. 7 and 8, forms a photograph-receiving pocket 24 upon being folded into coextensive overlying relation to the panel 12 about the fold line 20. The frame panel 16 will have the free vertical outer edge portion 26 thereof, parallel to the crease 20, adhesively bonded to the corresponding outer edge portion 28 of backing panel 12 to retain the panels 12 and 14 in the pocket-defining configuration. The upper and lower edges of the defined pocket 24 will remain open for facilitating introduction and positioning of a photograph 30 within the pocket 24.

The frame panel 16, as will be appreciated from the drawings, includes a cut-out window 32 therein through which the mounted photograph 30 is viewed and which, in conjunction with the remainder of the panel 16, defines a photograph-surrounding frame or border.

The blank 10 is completed by an easel brace panel 36 vertically above the support panel 14 and integrally joined along the upper edge thereof by fold or crease line 38. The brace panel 36 includes multiple substantially equal height transverse sections including two inner brace sections 40 and 42 of a width equal to the width of the support panel 14, and two outer tongue sections 44 and 46 which are of a lesser width. One or both of the tongue sections are selectively receivable within locking slot 34 in the backing panel 12. This slot 34 parallels the lower edge of panel 12 at a height slightly less than that of the lower edge of opening 32. As will be appreciated from the drawings, the lateral ends of the inner section 44 of the tongue sections are slightly concave, providing for a smooth arcuate transition between the brace and tongue sections. The brace sections 40 and 42 have a fold line 48 defined therebetween. Similar fold lines 50 and 52 are respectively defined between brace section 42 annd tongue section 44, and between tongue sections 44 and 46.

The height of the support panel 14 will normally be less than that of the backing panel 12, with the combined height of the support panel 14 and immediately adjacent brace section 40 equaling the height of the backing panel 12.

The brace panel is completed by the provision of a cut-out segment-shaped opening 54 centrally through the outer brace section 42 with the base of the opening 54 along the fold line 50 between the sections 42 and 44. This opening 54 extends through a major portion of the height of the section 42 and is of a width and height sufficient to accommodate a fingertip for purposes to be described subsequently.

FIGS. 7 and 8 illustrate the mount ready for use with the blank folded to define the photograph-receiving pocket 24. This will usually be the form in which the mount is distributed as a sale item, give-away, premium or the like.

After insertion of a photograph or picture, as suggested in FIG. 8, the mount is folded for use as a mailer, illustrated in FIGS. 1 and 2, or as a display frame, illustrated in FIGS. 3 and 4. The versatility of the mount will, in most cases, result in its use initially as a mailer for the photograph and subsequently, after being received by the recipient, use as a display frame.

For use as a mailer, the support panel 14 is folded over the pocket-defining frame panel 16 along the fold or crease line 14. As suggested in the FIG. 6 illustration of the blank 10, the fold line 18 is slightly wider to accommodate the panel 16. This folding of the support panel 14 over the frame panel 16 encloses the open upper edge of the pocket 24 for a positive locking of the photograph 30 therein.

Noting FIG. 1, and as previously indicated, the combined height of the support panel 14 and the first brace section 40 equal that of the backing panel 12 and hence the pocket 24 defined therewith. Thus, the exposed face of the panel 14 and section 40 constitute the address face of the mailer.

Noting FIG. 2, in the mailer configuration the remainder of the brace panel 36, outward of the inner brace section 40, is folded over and closes the second edge of the photograph pocket, that is the lower edge as viewed in FIG. 8 and the upper edge as viewed in FIGS. 1 and 2. This folding of the brace panel 36 is effected along the fold or crease line 48 which, in order to accommodate the multiple thicknesses of the pocket-defining panels 12 and 16, is of a width slightly greater than the width of fold line 18 and substantially greater than the width of the remaining fold lines 38, 50 and 52. Primarily, the width of the fold line 48 is such as to allow for a folding of the portion of the brace panel beyond the fold line into parallel overlying relation to the support panel 14 with the pocket-defining panels 12 and 14 received therebetween without distortion of the panels or the introduction of uncontrolled bending or folding such as might result in cracking or tearing of the thin material.

As the brace panel is folded about the pocket portion of the mount, the outer tongue sections 44 and 46 are introduced through the tongue locking slot 34 which is positioned, relative to the adjacent enclosed edge, to retain the second brace section 42 exposed along the back of the mailer. This brace section 42 includes the aforedescribed finger-accommodating opening 54 with the base of the opening adjacent the slot 34 and with the segmental opening exposed outwardly of the slot whereby a recipient of the mailer need merely engage his finger in the opening 54 and, with an outward motion toward the adjoining edge of the mailer, easily retract the tongue sections from the slot 34, thus opening the mailer.

In both opening and closing the mailer, the creases 38, 50 and 52 allow for a controlled bending or flexing of the brace panel 36 along defined lines and in a manner which allows for an engagement and disengagement of the tongue portion without potentially damaging or weakening random cracking or bending of the thin panels.

As will be appreciated from FIGS. 1 and 2 in particular, the mailer, when closed, provides for a positive closure of the normally open upper and lower edges of the pocket, thus effectively confining the photograph against any possibility of discharge from the pocket.

With continued reference to the finger-accommodating opening 54, the central location of this opening allows for an equal distribution of the tongue-withdrawing force so as to avoid any twisting, jamming or tearing of the tongue or brace panel such as might result were it necessary to grasp an edge portion of the panel to effect a removal of the tongue sections.

Figure 5:
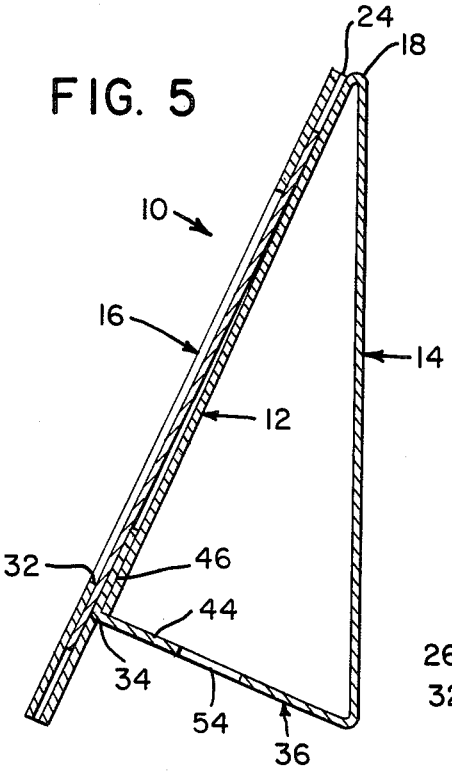
FIG. 5 is an enlarged transverse cross-sectional view taken substantially on a plane passing along line 5—5 in FIG. 4.

FIGS. 3, 4 and 5 illustrate the display frame configuration wherein the mount, normally after having been received in its mailer configuration, has the support panel 14 rearwardly folded about the fold line 18 and angled to diverge downwardly from the upper end of the pocket-defining panels 12 and 16, providing an easel support. The brace panel 36 folds inwardly about fold line 38 and extends forwardly toward the rear face of the backing panel 12 whereat the outer tongue section 46 engages through the tongue or locking slot 34, preferably angling upwardly between the rear face of the photograph 30 and the front face of the backing panel 12. Thus positioned, the tongue section is effectively retained and also provides for an enhanced frictional gripping of the photograph within the pocket.

Inasmuch as the support panel 14 is of a height less than that of the pocket-forming panels 12 and 16, the display frame will incline slightly rearward, providing for a more pleasing visual display of the mounted picture. The formation of the brace panel 36 with multiple crease-defined sections allows for a further controlled flexing of this panel to both insert and disengage the outer tongue section 46 without random creasing, cracking or possibly tearing the brace panel. Further, minor deviations in the angle of the easel-defining support panel 14 relative to the pocket-defining panels is also possible by a controlled folding of the brace panel sections along selected ones of the fold or crease lines.

It is to be appreciated that the mount or display mailer, in the display configuration thereof, also provides for a positive retention of the photograph within the pocket in that the lower edge of the pocket engages directly on the support surface, tabletop, desk or the like, while the only remaining open edge of the pocket is upwardly directed. Additional stability for the photograph within the pocket is provided, as previously mentioned, by the outer tongue section 46 frictionally introduced between the back of the photograph and the front of the backing panel 12.

FIGS. 9–13 illustrate an embodiment of the invention wherein provision is made for the the mounting the display of two photographs, pictures or the like. In this embodiment, the blank 56 is similar to the blank 10 in incorporating a central backing panel 58, a vertically aligned support panel 60 joined thereto by a fold or crease line 62, a brace panel 64 vertically aligned with the support panel 60 and integrally joined therewith along fold or crease line 66, and a frame or border-defining panel 68 laterally of and integrally joined with a side edge of the backing panel 58 along a vertical fold or crease line 70. As a variation of the blank 10, the blank 56 illustrates the frame panel 68 as projecting to the right of the backing panel rather than to the left.

Figure 9:
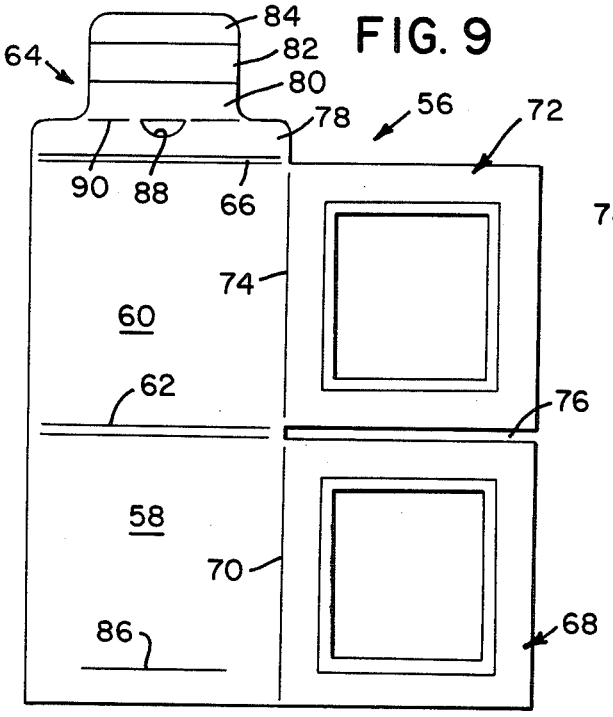
FIG. 9 is a plan view of the blank of another embodiment of the display mailer.
Figure 10:
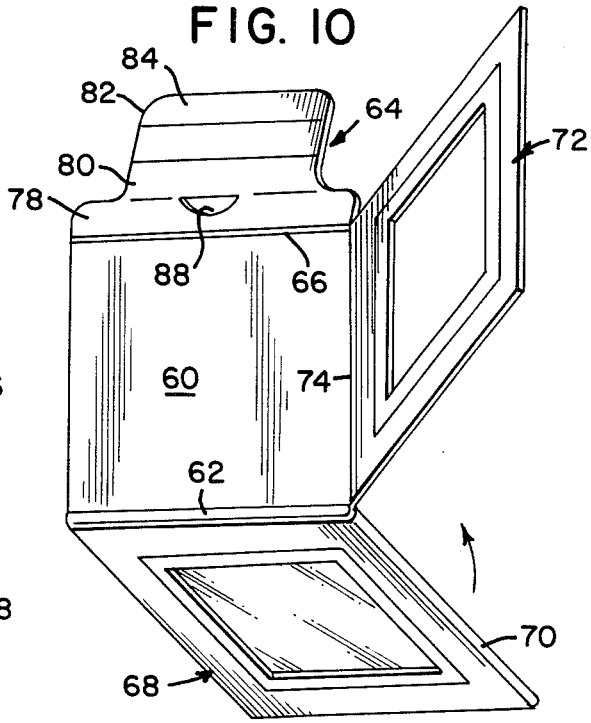
FIG. 10 is a perspective view of the blank of FIG. 9 partially formed and folded into a dual pocket configuration.
Figure 11:
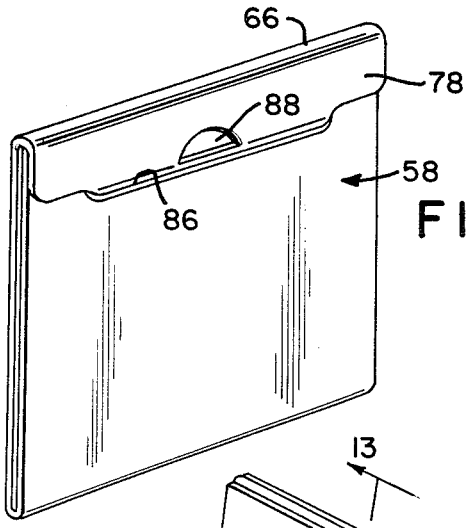
FIG. 11 is a rear perspective view of a mailer formed from the blank of FIG. 9.

The blank 56 differs from the blank 10 in that a second laterally positioned frame or border panel 72, with a die-cut window therein, is integrally joined to the vertical edge of the support panel 60 by a fold line 74 defining a linear extension of the fold line 70. The frame panel 72, in the blank as illustrated in FIG. 9, is vertically aligned with the frame panel 68, and is spaced therefrom to define a slot 76 of a height or vertical width equal to or slightly greater than that of the aligned crease or fold line 62.

Figure 13:
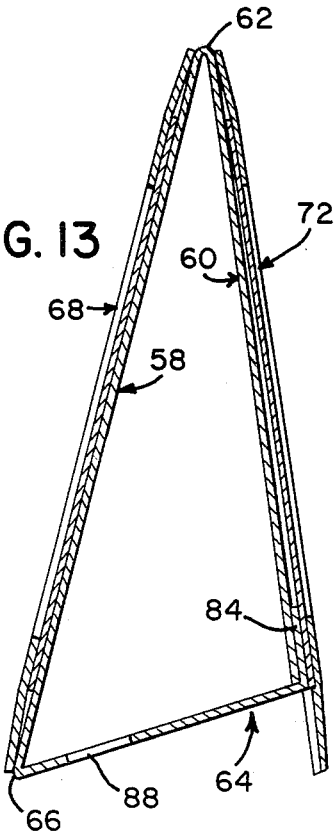
FIG. 13 is an enlarged transverse cross-sectional view centrally through FIG. 12 on line 13—13.
Figure 12:
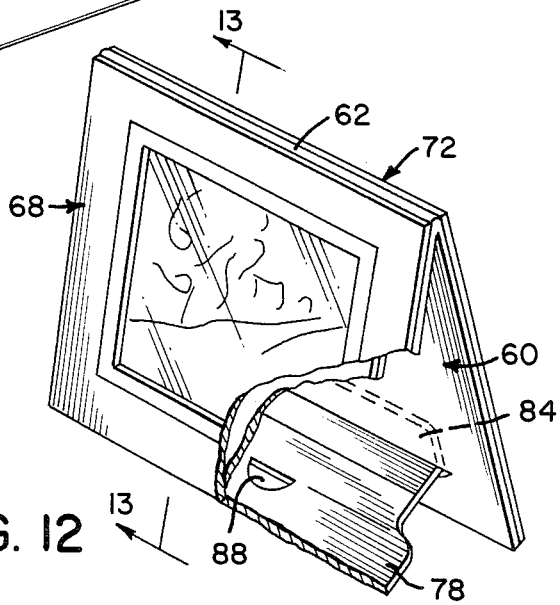
FIG. 12 is a front perspective view of a display frame formed from the blank of FIG. 9.

The panels 58, 60, 68 and 72 are preferably rectangular and of equal height and equal width. As suggested in FIG. 10, the frame panels 68 and 72, in initially assembling the blank, fold over the panels 58 and 60 respectively and are glued thereto along the remote side edge portions to define a pair of photograph pockets, each including open photograph-receiving upper and lower edges. The formed pockets are of equal height whereby, in the display configuration, as illustrated in FIGS. 12 and 13, both photographs are equally displayed.

The brace panel 64 includes four sections, an innermost section 78 of equal width and integrally joined to the upper edge of the support panel 60 by fold line 66, and three equal height tongue sections 80, 82 and 84. The three tongue sections are relatively narrower than the section 78 and specifically adapted for engagement through a tongue or locking slot 86 defined through the backing panel 58 parallel to the lower edge of the panel 58 and preferably at a height slightly less than the lower edge of the opening in the corresponding frame panel 68.

When assembled as a mailer, the two formed pockets are folded into facing overlying relation about the relatively wide fold line or crease 62, thereby sealing the open adjacent inner edges thereof. The brace panel is then folded, about the fold line 66, over the outer pocket edges with the tongue sections 80, 82 and 84 engaged through the locking slot 86, thereby sealing the mount in the mailer configuration. As will be appreciated, the height or vertical width of the fold line 66, again as the blank is illustrated in FIG. 9, is relatively greater than the fold line 62 to accommodate the multiple thicknesses defined by the two formed pockets. When assembled in the mailer configuration, it will be recognized that all of the edges of the pockets are completely sealed against any accidental discharge of the photographs.

The provision of the brace panel 64 as multiple sections defined by predetermined fold lines enables a proper flexing of this panel 64 as the panel is manipulated either into the mailing configuration or into the easel configuration, and avoids any possibility of accidental breaking, tearing or the like. As with the first embodiment, the brace panel 64 specifically includes a finger-accommodating grip aperture 88. This aperture or opening 88 is segment shaped and is centrally located along the innermost section 78, extending to approximately mid height therein downward from the linear base coextensive with the fold line 90 between sections 78 and 80. Noting the mailing configuration of FIG. 11, the arcuate portion of the finger opening 88 is outwardly directed toward the adjacent folded edge defined by the fold line 66 whereby, through an engagement of a finger within the opening 88, the tongue sections can be easily moved outward of the slot 86 with no undue stress thereon or damage thereto. This is particularly significant in that the brace panel is to be subsequently used as an easel brace as illustrated in FIGS. 12 and 13.

With regard to the easel or display configuration of FIGS. 12 and 13, it will be noted that the outermost tongue section 84, upon an inverting of the pockets from their mailing position, is inserted into the slot 86 with the remainder of the brace panel defining a support brace. The support brace is easily manipulated to engage the outermost tongue section 84 through the provision of the transverse fold lines, and similarly, is capable of a minor degree of adjustment to slightly vary the angle of the photograph pockets relative to each other.

A further embodiment of the invention is illustrated in FIGS. 14–17. In this embodiment, noting the one-piece blank in FIG. 14, the arrangement and operating interrelationship of the backing panel 90, support panel 92, brace panel 94 and frame or border-defining panel 96 duplicate those of the panels 58, 60, 64 and 68 of the embodiment of FIG. 9. However, rather than providing a frame or border-defining panel associated with the support panel 92, the embodiment of FIG. 14 incorporates an integral carrier panel 98. The carrier panel 98 extends laterally of the support panel 92 and is integral therewith along vertical fold line 100 which constitutes a linear continuation of the vertical fold line 102 between the backing panel 90 and the associated frame panel 96. The lower edge of the carrier panel 98 is spaced from the upper edge of the frame panel 96 immediately therebelow to define an elongate slot linearly aligned with the fold line 104 between the backing panel 90 and the support panel 92 to allow for an unencumbered folding, about fold line 104, into both the mailer and display configurations.

The carrier panel 98 is specifically adapted to provide for the carrying or storing of multiple photographs, primarily in the mailer configuration. It is presently contemplated that the carrier panel accommodate a stack of up to ten photographs.

In order to accommodate the stack of photographs, the carrier panel 98 is die-cut to define a pair of laterally spaced vertically extending, die-cut retaining flaps 106. Each of the flaps 106 is basically in the nature of an elongate segment with the linear base line thereof hinged to the panel 98 along a vertical crease or fold line 108 paralleling an adjoining vertical side edge of the panel 98 in inwardly spaced relation thereto. The arcuate peripheries of the flaps 106 are inwardly directed and terminate in spaced relation to each other. The vertical extent of the flaps 106, adjacent the linear bases thereof, is approximately equal to the height of the photographs to be accommodated therein.

The blank is initially erected by a folding of the frame panel 96 and carrier panel 98 into overlying engagement with the respective associated panels 90 and 92. As in the previous embodiment, the free outer vertical edges of the panels 96 and 98 are adhesively bonded to the corresponding free outer edges of the panels 90 and 92. To provide additional security for the carrier panel 98, the upper and lower edges thereof, or even the entire body thereof other than for the retaining flaps 106, can also be bonded to the underlying support panel 92.

In use, the opposed retaining flaps 106 will be slightly flexed outward and the stack of photographs introduced therebeneath, preferably being slid in from either the upper or lower edge of the panel 98 whereby minimal flexing of the panels 106 is required. The creases 108 about which the flaps 106 flex are preferably minimal in order to retain a maximum inherent resilient memory within the material. In this manner, the flaps 106 will tend to automatically clamp down on and retain the stored photographs, the creases 108 providing a minimal guide insuring a proper flexing of the flaps along the linear edges thereof.

Figure 14:
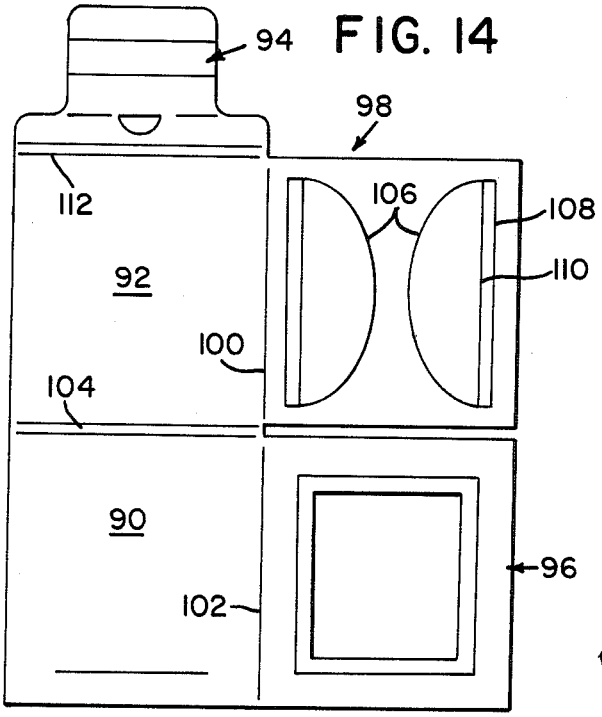
FIG. 14 is a plan view of the blank of a further embodiment of the display mailer.
Figure 15:
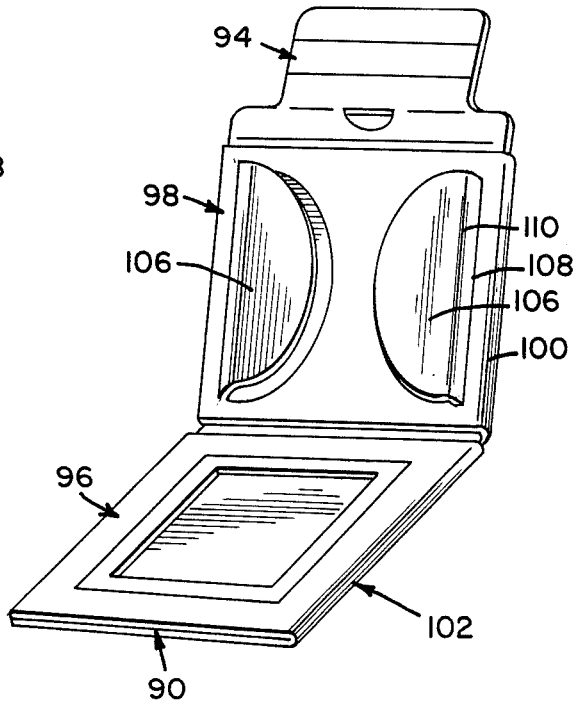
FIG. 15 is a plan view of the blank of FIG. 14 with the panels folded to define a picture pocket and a picture carrier.
Figure 16:
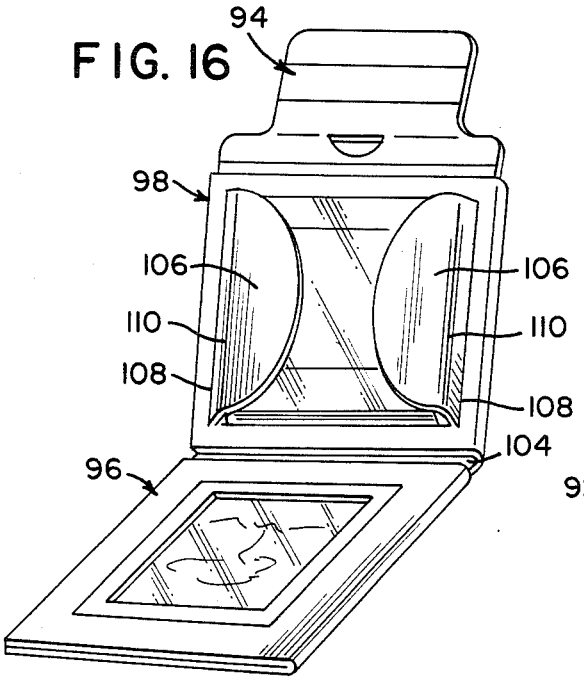
FIG. 16 is a perspective view similar to FIG. 15 with a stack of photographs mounted in the carrier.

As suggested in FIGS. 14 and 15, a second minimally disruptive crease 110 can be provided vertically along each flap 106 in closely adjacent inwardly spaced relation to the outermost crease 108. The creases 110 will provide second lines along which the flaps can fold to assume a generally flat position overlying the stack of photographs to more effectively retain the photographs and provide for a more compact overall configuration both as a mailer and as a display frame.

Figure 17:
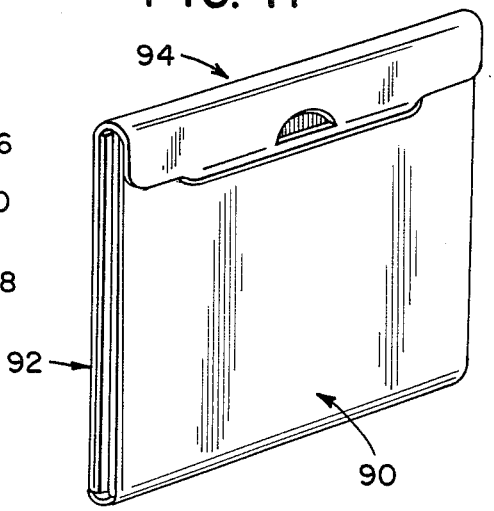
FIG. 17 is a perspective view of structure of FIG. 16 folded as a mailer.

Inasmuch as this embodiment of the invention contemplates accommodating a relatively thick stack of photographs, both the fold line 104 between the panels 90 and 92, and the fold line 112 between the panel 92 and the brace panel 94 are to be of a width or height substantially greater than the remaining fold lines in order to maintain a flat mailer configuration as suggested in FIG. 17. It will also be recognized that, upon a folding of the display mailer into the mailing configuration, the open upper and lower ends of the carrier panel are completely enclosed, thereby effecting a positive retention and protective enclosure of the photographs.

In the display configuration, only a single photograph will be displayed through the frame or border-defining panel 96. The carrier panel, as desired, may be used to retain a stack of photographs in a stored position behind the display frame for periodic substitution with the displayed photograph.

It will also be recognized that the converting of the carrier embodiment between the mailing and displaying configurations is effected, through the multiple section brace panel 94, in the same manner as described with regard to the embodiment of FIGS. 9–13.

The foregoing is considered illustrative of the principles of the invention which is not considered limited to the specific embodiments presented.

What is claimed is:

1. A one-piece picture mount formed from a planar blank for alternate assembly into a mailer and a display frame, said mount comprising a picture-receiving pocket defined by a backing panel and an overlying frame panel with a first fold line therebetween, said backing and frame panels having secured overlying edge portions remote from and parallel to said first fold line, said frame panel including at least one line of adhesive along said overlying edge portion whereby to secure said overlying edge portions together, a support panel immediately adjacent and integral with said backing panel along a second fold line transverse to said first fold line for a selective folding of said support panel between a forwardly folded mailer position overlying said frame panel and a rearwardly folded display position diverging from said backing panel, and a brace panel immediately adjacent and integral with said support panel along a third fold line parallel to said second fold line for a selective folding of said brace panel into overlying relation to the backing panel in the mailer position and into bracing orientation between the diverging support panel and backing panel in the display position, said brace panel including multiple fold line-defined sections parallel to said third fold line, at least the outermost one of said sections, relative to the backing panel, defining a tongue, said backing panel including a locking slot therethrough selectively receiving said tongue in each of said mailer and display positions.

2. The picture mount of claim 2, including a finger-accommodating opening defined in said brace panel in the section immediately inward of said tongue.

3. The picture mount of claim 2, wherein said support panel is of a height, between the pocket and said brace panel, less than that of the pocket whereby said pocket, in the display portion of the support panel, is oriented at a viewing angle greater, relative to the horizontal, than said support panel.

4. The picture amount of claim 3, wherein the combined height of said support panel and the first section of the brace panel immediately adjacent thereto is equal to the height of said pocket.

5. The picture mount of claim 4, wherein said finger-accommodating opening is defined in the second brace panel section outward from said support panel.

6. The picture mount of claim 5, wherein said tongue is defined by two brace panel sections.

7. The picture mount of claim 6, wherein said defined tongue is narrower than the remainder of said brace panel.

8. The picture mount of claim 3, including a picture-receiving opening defined in said pocket along said second fold line for selective closing by folding of the support panel thereover.

9. The picture mount of claim 1, including a picture-receiving opening defined in said pocket along said second fold line for selective closing by folding of the support panel thereover.

10. The picture mount of claim 1, including a picture retaining panel overlying said support panel.

11. The picture mount of claim 10, wherein said picture retaining panel comprises a second frame panel defining a second picture-receiving pocket with said support panel.

12. The picture mount of claim 10, wherein said picture retaining panel comprises a carrier panel including flap means defined therefrom and selectively outwardly flexible relative to the support panel for the retaining accommodation of pictures inward thereof.

13. The picture mount of claim 12, wherein said flap means comprises a pair of opposed segment-shaped flaps cut from the retaining panel and integral therewith along lines of flexure, said flaps being inwardly directed toward each other for the accommodation of pictures therebetween.

14. The picture mount of claim 13, wherein said flaps extend transversely of said second and third fold lines.

15. The picture mount of claim 10, including a finger-accommodating opening defined in said brace panel in the section immediately inward of said tongue.

16. The picture mount of claim 15, wherein said finger-accommodating opening is in the first brace panel section immediately outward of the support panel.

17. The picture mount of claim 16, wherein said defined tongue is narrower than the remainder of said brace panel.

18. In a one-piece picture mount, a mount forming planar blank, said blank comprising a backing panel having first and second angularly related edges, a frame panel and a support panel respectively immediately adjacent to and integrally joined to said first and second edges along defined first and second fold lines, said frame panel being of substantially equal size with said backing panel and positionable in overlying relation thereto to define a picture-receiving pocket, said backing and frame panels having secured overlying edge portions remote from and parallel to said first fold line, said frame panel including at least one line of adhesive along said overlying edge portion whereby to secure said overlying edge portions together, said frame panel having a viewing window defined therethrough, said backing panel having a tongue slot therein generally paralleling said second fold line remote therefrom, and a brace panel immediately adjacent and integrally joined to said support panel along a third fold line remote from and generally parallel to said second fold line, said brace panel including multiple sections defined by spaced fold lines generally paralleling said third fold line, said support panel being selectively foldable, about said second fold line, to a first forward position overlying a defined picture-receiving pocket and a second rearward position diverging from said back panel and defining an easel support, the outer portion of said brace panel, relative to said support panel, defining a tongue receivable through said tongue slot in each position of said support panel for a fixing of the support panel respectively in each of said positions.

19. In the one-piece picture mount of claim 18, said brace panel, inward of the defined tongue, including a gripping opening defined therethrough and exposed, upon reception of the tongue in the tongue slot, for facilitating withdrawal of the tongue.

20. In the one-piece picture mount of claim 19, said backing, frame and support panels being rectangular.

21. In the one-piece picture mount of claim 20, the height of said support panel, between the backing panel and the brace panel, being less than that of the backing panel.

22. In the one-piece picture mount of claim 21, the combined height of said support panel and the first section of the brace panel immediately adjacent thereto equaling the height of the backing panel.

23. In the one-piece picture mount of claim 22, said second fold line being of greater width than said first fold line for the accommodation of the support panel over the overlying frame and backing panels, the fold line between the first brace panel section adjacent the support panel and the section immediately adjacent thereto being of a width greater than said second fold line for accommodation of the brace panel about the backing, frame and support panels.

24. In the one-piece picture mount of claim 20, a picture retaining panel integral with said support panel along an edge thereof parallel to the first edge of the backing panel to which the frame panel is joined for folding into overlying relation to said support panel.

25. In the one-piece picture mount of claim 24, the edge of the support panel along which the picture retaining panel is joined is linearly aligned with the first edge of the backing panel, said frame panel and said picture retaining panel having spaced adjacent parallel edges substantially aligned with said second fold line.

26. In the one-piece mount of claim 25, said picture retaining panel having opposed flaps integrally joined to the panel and selectively flexible therefrom for reception of pictures therebetween.

* * * * *